US009766590B2

(12) United States Patent
Stranczl

(10) Patent No.: US 9,766,590 B2
(45) Date of Patent: Sep. 19, 2017

(54) METHOD OF PRODUCING A DECORATED COMPONENT FOR A TIMEPIECE OR PIECE OF JEWELLERY, AND COMPONENT MADE BY THE METHOD

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/918,912

(22) Filed: Oct. 21, 2015

(65) Prior Publication Data

US 2016/0179057 A1 Jun. 23, 2016

(30) Foreign Application Priority Data

Dec. 17, 2014 (EP) ..... 14198634

(51) Int. Cl.

| | |
|---|---|
| ***G04B 45/00*** | (2006.01) |
| ***G04B 19/04*** | (2006.01) |
| ***G04B 19/32*** | (2006.01) |
| ***C23F 1/00*** | (2006.01) |

(52) U.S. Cl.

CPC ..... *G04B 45/0076* (2013.01); *C23F 1/00* (2013.01); *G04B 19/042* (2013.01); *G04B 19/32* (2013.01)

(58) Field of Classification Search

CPC .. G04B 45/0076; G04B 19/32; G04B 19/042; C23F 1/00

See application file for complete search history.

(56) References Cited

U.S. PATENT DOCUMENTS

| | | | | |
|---|---|---|---|---|
| 5,966,344 | A | 10/1999 | Umemoto et al. | |
| 2003/0007425 | A1 | 1/2003 | Amano et al. | |
| 2008/0198702 | A1* | 8/2008 | Meister | B81C 99/008 368/232 |
| 2012/0047950 | A1* | 3/2012 | Grotjohn | A44C 17/003 63/32 |

FOREIGN PATENT DOCUMENTS

| | | |
|---|---|---|
| CH | 155 823 | 7/1932 |
| CH | 314 048 | 5/1956 |
| EP | 2 138 323 A1 | 12/2009 |
| JP | 60 17383 | 1/1985 |

OTHER PUBLICATIONS

Madou, Marc, "Fundamentals of Microfabrication," Chapter 2—Pattern Transfer with Dry Etching Techniques, pp. 53-88. 1997.*

European Search Report dated Aug. 7, 2015 in European Application 14198634, filed on Dec. 17, 2014 (with English Translation and Written Opinion).

* cited by examiner

*Primary Examiner* — Duy Deo
*Assistant Examiner* — Mahmoud Dahimene
(74) *Attorney, Agent, or Firm* — Oblon, McClelland, Maier & Neustadt, L.L.P.

(57) ABSTRACT

The method makes it possible to produce a decorated component for a timepiece or piece of jewellery. This component provided with the decoration may be, for example, a watch hand. To produce said component, a base substrate is used and a micromachining operation is performed on or in the base substrate to obtain an upper part of the component, which is provided with the decoration. The decoration is produced through the thickness of the upper part and in a programmed pattern. Thereafter, the upper part is placed on a luminescent or colored substance to obtain the component.

13 Claims, 2 Drawing Sheets

METHOD OF PRODUCING A DECORATED COMPONENT FOR A TIMEPIECE OR PIECE OF JEWELLERY, AND COMPONENT MADE BY THE METHOD

This application claims priority from European Patent Application No. 14198634.9 filed on Dec. 17, 2014, the entire disclosure of which is hereby incorporated herein by reference.

FIELD OF THE INVENTION

The invention concerns a method of producing at least one component provided with a decoration for a timepiece or piece of jewellery.

The invention also concerns a component provided with a decoration obtained according to the production method.

BACKGROUND OF THE INVENTION

Generally, in any method for producing a decoration on a component for a timepiece or piece of jewellery, it is difficult to structure said decoration in order to produce fine lacework cutouts or to obtain microstructures. Several operations for producing the decoration are also performed manually. This makes it impossible for the same decoration to be easily reproduced from one part to the next, which is a drawback.

JP Patent Application No. S60-17383 A describes a method for manufacturing a watch dial provided with a decoration. To achieve this, hollows are made by etching or mechanical cutting in a certain pattern in a metal-based substrate of the dial. One or more paints are inserted in the hollows created in order to decorate said watch dial. A polishing operation can also be provided to finish the decorated dial. However, it is also impossible to make a decoration with a fine pattern on said dial, which is a drawback.

It is also known in the prior art to produce one or more decorative parts intended to be mounted on a watch. These decorative parts consist of aesthetic elements inlaid on a portion of the watch. This may be a watch bezel decorated with patterns, such as indices. The bezel, made for example of ceramic, may be marked notably in gold, silver or platinum, with raised or deep markings. Deep marking is achieved by filling hollows formed earlier in the support.

The principle used for producing such deep marking consists in first of all depositing a conductive layer by physical vapour deposition (PVD). Once the conductive layer has been deposited, the hollows are filled with a metal by electroforming, by immersing the part in a metal ion bath and passing an electrical current through the bath. The hollows are therefore filled with metal to form said marking. However, this method is complex and relatively slow to implement to produce the decorative part on the watch, since several production steps are required, which is a drawback. Further, it is not intended to obtain microstructures, which is a drawback.

Reference may be made in this regard to EP Patent Application No. 2 138 323 A1, which concerns a watch bezel with inlaid indices. However, as previously mentioned, it is not intended to easily produce microstructures or fine lacework for decorating a watch component, which is a drawback.

It is also known in the prior art to produce decorative parts, which are formed of a metal-based substrate, inlaid with elements, for example made of glass. To achieve this, said elements are disposed in a mould and a liquid metal is poured onto the elements in the mould. Once the metal has solidified, a polishing operation must also be performed on the metal-based substrate, which includes the decorative elements, in order to remove the surplus metal around the elements. However, it is not possible to produce fine decorations on the base substrate and further, the decorative elements are not guaranteed to be held in the base substrate after polishing, which constitute drawbacks.

Patent Publication Nos US 2003/0007425 A1, CH 155 823, U.S. Pat. No. 5,966,344 A and CH 314 048 describe the production of a watch component, such as a dial or watch hand. Through holes are made in a plate of the component to define a decoration element or time indicators for a watch dial. These holes are also filled with a luminescent substance. However, it is not intended to form a decoration by micromachining in order to obtain fine lacework cutouts or to obtain microstructures, which is a drawback.

SUMMARY OF THE INVENTION

It is therefore an object of the invention to propose a method for producing a component provided with a decoration for a timepiece or piece of jewellery that overcomes the drawbacks of the aforementioned prior art to facilitate the manufacture of such a decorated component, and the reproducibility or specificity thereof.

To this end, the invention concerns a method for producing a component provided with a decoration for a timepiece or piece of jewellery, wherein the method includes the steps of:

- taking a base substrate, and performing a micromachining operation on or in said base substrate in order to obtain an upper part of the component, which is provided with a decoration of micrometric structure traversing the thickness of the upper part in a programmed pattern, and
- fixing the upper part on a luminescent or coloured substance, or coating a back portion of the upper part with the luminescent or coloured substance.

One advantage of the method for producing a decorated component lies in the fact that it is possible to produce a very fine decorative pattern in the upper part of the component in the form of fine lacework through a micromachining operation. The decorative pattern is produced through the thickness of the upper part, which makes it possible, with the use of a luminescent substance placed on a back portion of the upper part, to make said decoration even visible in the dark.

Advantageously, the decorative pattern or patterns are drawn or programmed on a computer. The stored data for the decorative pattern or patterns is supplied to a micromachining machine in order to produce the upper part with the desired decoration.

Advantageously, a LIGA type technology may be used to make the upper part of the component. To achieve this, there is first of all taken a metal or semiconductor substrate, such as silicon, on which a photosensitive resin is deposited. The resin is illuminated through a mask representing the pattern to be made in the upper part. Galvanic metal growth occurs in the open parts of the resin. Thereafter, the base substrate is removed to obtain the upper part of the component. This upper part with the desired decorative pattern is fixed to a luminescent substance or the back thereof is coloured or coated with said substance.

Advantageously, a DRIE etching technology can be used on a semiconductor substrate, such as silicon, to produce the upper part of the component with the decorative pattern.

To this end, the invention also concerns a decorated component obtained according to the production method, wherein the component includes an upper part with a decoration produced through the thickness of the upper part, and a luminescent or coloured substance fixed to a back portion of the upper part.

BRIEF DESCRIPTION OF THE DRAWINGS

The objects, advantages and features of the method for producing a decorated component for a timepiece or piece of jewellery and the obtained decorated component will appear more clearly in the following description with reference to the drawings, in which.

DETAILED DESCRIPTION OF THE INVENTION

In the following description, any techniques for producing decorative patterns for a watch or jewellery component that are well known in the state of the art will be mentioned only in a simplified manner. The decorative patterns concern fine openings or micrometric openings, which are made in an upper part of the component by techniques defined as micromachining techniques.

Figure 1A:
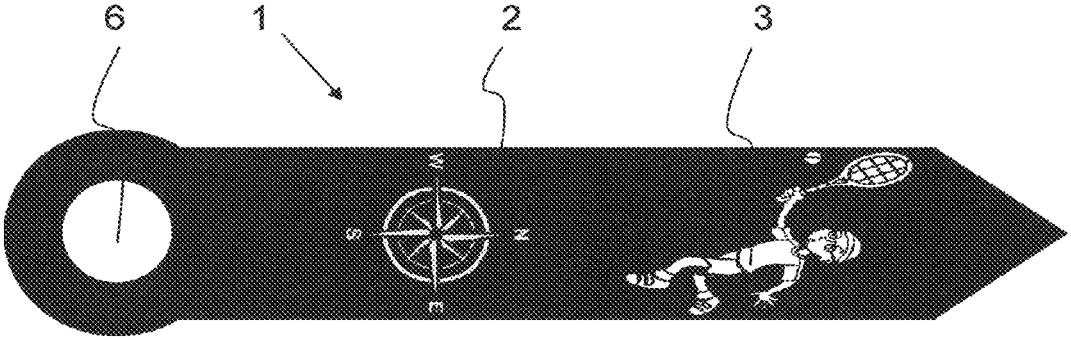
FIGS. 1*a* and 1*b* show a top view and simplified sectional view of a first embodiment of a component for a watch or piece of jewellery obtained by the method for producing the component according to the invention.
Figure 1B:
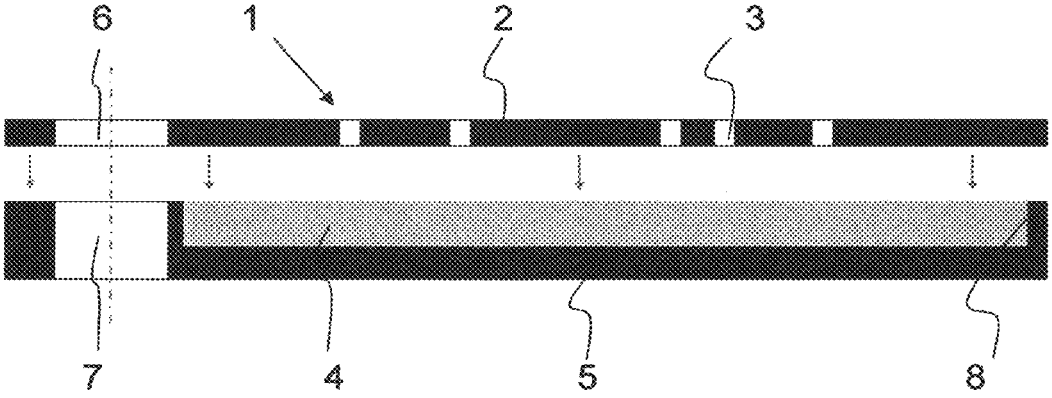

FIGS. 1*a* and 1*b* show a top view and a simplified exploded sectional view of a first embodiment of a component 1, provided with a decoration, for a timepiece or piece of jewellery. FIG. 1*a* shows an upper part 2 of component 1. Upper part 2 includes a decorative pattern 3, representing for example an image or several images. The decoration is obtained by a micromachining technique, which may be, for example, a UV-LIGA or DRIE technique as explained below.

As shown more clearly in FIG. 1*b*, decoration 3 is precisely and very finely produced in a micrometric manner through the material of upper part 2 in a desired programmed pattern. The decorative pattern is first of all drawn or programmed in a computer, and the stored drawing or pattern data is transmitted to a micromachining machine in order to produce the decoration in upper part 2. The openings or micro-openings of decoration 3 are shown in a very simplified manner in FIG. 1*b* and do not directly match the desired pattern shown in FIG. 1*a*.

In this first embodiment, once decoration 3 has been micromachined, upper part 2 is attached to a base support 5. Upper part 2 is aligned via its axial opening 6 on another axial opening 7 of the base support for attachment. A housing 8 is also made in this base support 5 and filled with a luminescent substance 4 or a desired paint. The luminescent substance may be the substance known as Luminova, and it mainly includes strontium aluminate or zinc sulphide depending on the desired colour. Substance 4 is deposited in housing 8 of base support 5 up to the level of the opening of housing 8. Once upper part 2 has been attached to the upper surface of base support 5 to cover the opening of housing 8 with substance 4, component 1 is finished.

As shown in FIGS. 1*a* and 1*b*, the component 1 produced may advantageously be a watch hand. The general shape of upper part 2 may be similar to the general shape of base support 5. Openings 6 and 7 of substantially identical diameter allow the hand to be mounted on a drive arbor emerging from a watch dial, for example. The drive arbor is preferably attached to one of openings 6 and 7. Further, in the case of a luminescent substance 4 disposed underneath the upper part 2 visible from outside the timepiece or piece of jewellery, the fine decoration 3 produced in the upper part can be very clearly seen even in the dark.

Of course, the component 1 provided with a decoration may be an applique, a dial, at least one date disc or other disc of a complication, such as for the display of the vault of heaven with a starry sky produced in this manner. The component provided with a decoration may also be a piece of a mechanism, such as a seconds wheel, an oscillating weight or other piece, which must in principle be visible from outside the watch.

It is also to be noted that such a component 1 provided with a decoration can also be used in the battle against counterfeiting. In such case, each pattern to be produced through upper part 2 of component 1 can be drawn on a computer and stored in a specific manner for each timepiece or piece of jewellery. However, as decoration 3 is precisely produced in a micrometric manner, this complicates the making of any counterfeits.

Figure 2A:
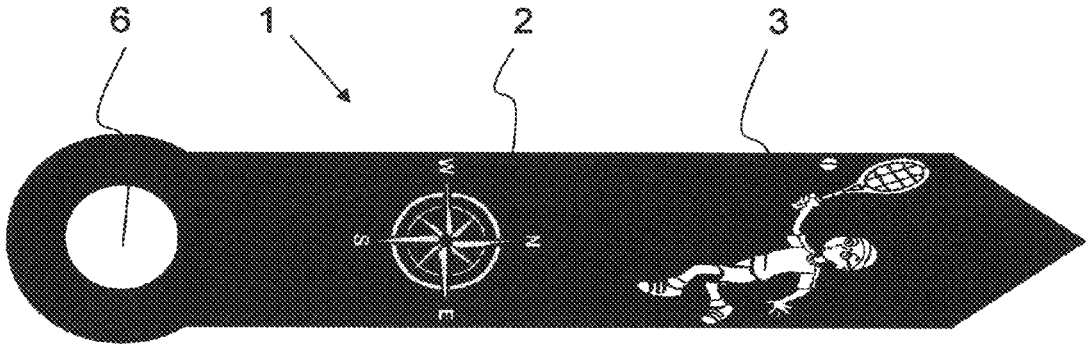
FIGS. 2*a* and 2*b* show a top view and simplified sectional view of a second embodiment of a component for a watch or piece of jewellery obtained by the method for producing the component according to the invention.
Figure 2B:
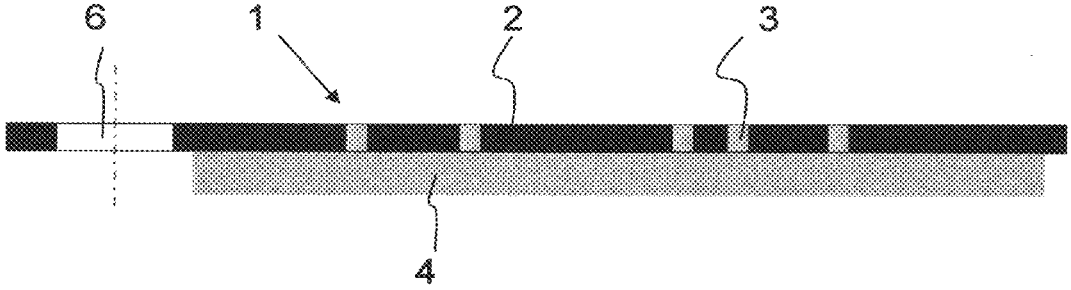

FIGS. 2*a* and 2*b* show a top view and a simplified sectional view of a second embodiment of a component 1, provided with a decoration, for a timepiece or piece of jewellery. As above in FIG. 2*a*, there is shown an upper part 2 of component 1 which includes a decorative pattern 3. This decorative pattern 3, represents, for example, an image or several images. The decoration is obtained by a micromachining technique, which may be, for example, a UV-LIGA or DRIE process as explained below.

Referring to FIG. 2*b*, decoration 3 is precisely and very finely produced in a micrometric manner through the material of upper part 2, which defines a fine lacework. The pattern of decoration 3 is first of all drawn or programmed in a computer, and the stored drawing or pattern data is transmitted to a micromachining machine in order to produce the decoration in upper part 2. The openings or micro-openings of decoration 3 are shown in a very simplified manner in FIG. 2*b* and do not directly match the desired pattern shown in FIG. 2*a*.

In this second embodiment, once decoration 3 has been micromachined, at least one back portion of upper part 2 is coated with a luminescent substance 4 or with a coloured substance, such as paint or coloured lacquer. The decoration 3 produced is considered to be transparent by making fine openings or micrometrical decorative openings through the thickness of upper part 2. The substance coated on a back portion of upper part 2 at least partly penetrates the openings in decoration 3.

When a luminescent substance (Luminova) is used, this substance 4 can illuminate decoration 3 from below through the fine openings in upper part 2, particularly in the dark. As above, the axial opening 6 of upper part 2 of the component 1 in the form of a hand, allows the hand to be mounted on a drive axis, which emerges from a watch dial.

Upper part 2 or the base substrate used to produce upper part 2 of component 1 may be made of a metal, semiconductor, ceramic, amorphous metal or other material. As regards the ceramic material, this concerns alumina, zirconia, magnesium oxide, boron nitride, silicon nitride, silicon carbide, aluminium titanate and aluminium nitride, or other types of ceramic.

It is also possible to have an upper part 2 or base substrate made of amorphous metal, quartz, glass, sapphire, corundum or another type of precious stone.

A micromachining technique for producing upper part 2 of component 1 is for example the LIGA process (Lithographie, Galvanofomung and Abformung in German terminology). In that case, there is used a base substrate, which is preferably a semiconductor substrate, such as silicon, or even gallium arsenide, which may have a conductive upper layer for the electroforming operation. However, it is also possible to take a metal-based substrate, typically made of copper, which can avoid the need to make a sacrificial layer on the surface of the base substrate.

A photosensitive resin is deposited on the base substrate with the conductive surface layer. This photosensitive resin may be a polyimide PMMA (polymethyl methacrylate) based resin or an octafunctional epoxidized resin available from Shell Chemical under the reference SU-8 and a photoinitiator chosen from among triarylsulfonium salts. This resin may be photopolymerized by ultraviolet (UV) radiation. However, it is also possible to envisage having a resin that is sensitive to the X rays generated by a synchrotron, but this operation is too expensive for producing upper part 2 on the base substrate.

A contour mask of upper part 2 and the decorative pattern 3 to be made on the base substrate is placed on the resin. The mask may be a glass plate on which a masking layer is formed with opaque and transparent portions according to the pattern to be made. Light radiation, for example of the ultraviolet type, is directed onto the mask to irradiate the unmasked portions of the resin. When using this type of resin, which is a negative photosensitive resin, the non-irradiated portions can be removed by physical or chemical means. This defines the shape of upper part 2 with its decoration 3.

It is to be noted that a positive photosensitive resin may also be used, with a mask having a masking layer with opaque and transparent portions according to the pattern to be made. This mask is the reverse of the mask used with the negative resin. In this case, it is the irradiated portions of the resin that are removed.

Thereafter, an electroforming or electroplating operation is performed. At least one metallic material is grown in the open portions of the resin from the conductive layer formed at the surface of the base substrate. Once the thickness of the deposited metal layer is sufficient, the upper part 2 is made with the desired decorative pattern 3 and can be detached from the base substrate while also removing the resin. The metal or semiconductor based substrate may also be removed or eliminated before or after removal of the resin by a machining operation or selective dissolution operation.

It is to be noted that the metal materials deposited by the LIGA process may be nickel or nickel phosphorus alloys, or copper based alloys, gold or even steels. In principle, any metal or metal alloy that can be deposited by this electroforming method can be used.

Another technique for producing upper part 2 of component 1 consists in directly etching a base substrate in order to obtain the upper part immediately. The etch of the base substrate is a micromechanical machining operation. The DRIE process (deep reactive ion etching) is used. To achieve this, the base substrate must in principle be made of a material such as single crystal silicon, polycrystalline silicon, porous silicon, amorphous silicon, doped single crystal silicon, doped polycrystalline silicon, doped or undoped silicon carbide, doped or undoped silicon nitride or also based on gallium arsenide. Other types of materials able to be etched include quartz, foturan glass, and brittle materials such as sapphire and corundum for example.

In order to etch the substrate, a negative or positive photosensitive resin must first be deposited on the base substrate, which is illuminated through a mask defining the contours of the decorative pattern 3 to be made, and the periphery of the upper part 2 to be made. Depending on the type of resin used, the irradiated resin may be removed and an etch operation started in the uncovered part of the substrate. Thereafter, all the resin can be removed in order to obtain upper part 2 of component 1 with the decorative pattern 3 in upper part 2.

It is to be noted that, in reality, a structured resin is used to obtain a silicon oxide mask. This silicon oxide mask will be used in turn as the etching mask for the DRIE process. To achieve this, in a second variant of the DRIE process, there is first of all taken a silicon substrate, on which a certain thickness of silicon oxide ($SiO2$) is produced. Then, a photosensitive resin is deposited and the resin is structured by photolithography. The silicon oxide layer is etched as a result of the structuring of the resin which is subsequently removed. There is obtained a silicon substrate with a structured upper silicon oxide layer. This structured silicon oxide layer acts as a mask for the silicon etch in order to produce upper part 2.

From the description that has just been given, several variants of the method for producing a component provided with a decoration for a timepiece or piece of jewellery and the obtained component can be devised by those skilled in the art without departing from the scope of the invention defined by the claims.

The invention claimed is:

1. A method for producing a decorated timepiece component, the method comprising:

taking a base substrate and performing a micromachining operation on or in said base substrate in order to obtain an upper part of the component with a decoration of micrometric structure that extends completely through a thickness of the upper part in a programmed pattern, the micromachining operation including etching openings as part of the decoration that extend completely through the thickness of the upper part;

producing a base support that includes a housing extending upward from a surface of the base support, the base support including an opening within the housing;

filling the base support with a luminescent or colored substance up to a top of the opening of the housing; and after the filling the base support, fixing the upper part on the housing of the base support such that the luminescent or colored substance is visible through the openings in the decoration of the upper part.

2. The method for producing the decorated timepiece component according to claim 1, wherein the base substrate is made of metallic material or semiconductor material or ceramic material or amorphous metal, wherein the taking the base substrate and performing the micromachining operation includes the steps of:

depositing a layer of positive or negative photosensitive resin on the base substrate, placing a contour mask of the upper part and of the decorative pattern to be made on the photosensitive resin, illuminating the resin through the mask, removing illuminated resin portions, if the photosensitive resin is of the positive type, or removing non-illuminated resin portions, if the photosensitive resin is of the negative type, etching the base substrate in the portions removed from the resin to a depth corresponding to the thickness of the upper part with the decoration to be made, and removing all the resin and the portion of the base substrate below the upper part with the created decoration.

3. The method for producing the decorated timepiece component according to claim 1, wherein the base substrate is made of silicon, wherein the taking the base substrate and performing the micromachining operation includes the steps of:

producing a silicon oxide layer of a certain thickness on the silicon substrate, depositing a layer of positive or negative photosensitive resin on the silicon oxide layer, placing a contour mask of the upper part and of the decorative pattern to be made on the photosensitive resin, illuminating the resin through the mask, removing illuminated resin portions when the photosensitive resin is of the positive type, or removing non-illuminated resin portions when the photosensitive resin is of the negative type, etching the silicon oxide layer in the portions removed from the resin, removing all the resin, and etching the silicon substrate, the structured silicon oxide layer acting as the etching mask in order to produce the upper part.

4. The method for producing the decorated timepiece component according to claim 1, wherein the general shape of the upper part is similar to the general shape of the base support, on which the upper part is fixed to obtain a component, wherein the component is a watch hand, and wherein the substance is a luminescent substance.

5. The method for producing the decorated timepiece component according to claim 1, wherein the decorative pattern is drawn on a computer, and wherein stored decorative pattern data is transmitted to a micromachining machine to produce the upper part with the decoration.

6. The method for producing the decorated timepiece component according to claim 1, wherein the decorative pattern is drawn in a specific manner for the timepiece equipped with said produced component to prevent any counterfeiting.

7. The method for producing the decorated timepiece component according to claim 1, wherein the decorated timepiece component is a hand, an applique, a dial, a disc, or a piece of a mechanism of a watch that is visible from outside of the watch.

8. A method for producing a decorated timepiece component, the method comprising:

taking a base substrate and performing a micromachining operation on or in said base substrate in order to obtain an upper part of the component with a decoration of micrometric structure that extends completely through a thickness of the upper part in a programmed pattern, the micromachining operation including etching openings as part the decoration that extend completely through the thickness of the upper part; and after the taking the base substrate and performing the micromachining operation, coating a back portion of the upper part with a luminescent or colored substance such that the luminescent or colored substance is visible through the openings in the decoration of the upper part.

9. The method for producing the decorated timepiece component according to claim 8, wherein the decorated timepiece component is a hand, an applique, a dial, a disc, or a piece of a mechanism of a watch that is visible from outside of the watch.

10. The method for producing the decorated timepiece component according to claim 8, wherein the coating is performed such that the luminescent or colored substance at least partially penetrates openings in the upper part that form the decoration.

11. The method for producing the decorated timepiece component according to claim 8, wherein a back portion of the upper part, on which the decoration is created, is coated with the colored substance, and wherein the colored substance is a paint or a colored lacquer.

12. The method for producing the decorated timepiece component according to claim 8, wherein the base substrate is made of metallic material or semiconductor material or ceramic material or amorphous metal, wherein the taking the base substrate and performing the micromachining operation includes the steps of:

depositing a layer of positive or negative photosensitive resin on the base substrate, placing a contour mask of the upper part and of the decorative pattern to be made on the photosensitive resin, illuminating the resin through the mask, removing illuminated resin portions, if the photosensitive resin is of the positive type, or removing non-illuminated resin portions, if the photosensitive resin is of the negative type, etching the base substrate in the portions removed from the resin to a depth corresponding to the thickness of the upper part with the decoration to be made, and removing all the resin and the portion of the base substrate below the upper part with the created decoration.

13. The method for producing the decorated timepiece component according to claim 8, wherein the base substrate is made of silicon, wherein the taking the base substrate and performing the micromachining operation includes the steps of:

producing a silicon oxide layer of a certain thickness on the silicon substrate, depositing a layer of positive or negative photosensitive resin on the silicon oxide layer, placing a contour mask of the upper part and of the decorative pattern to be made on the photosensitive resin, illuminating the resin through the mask, removing illuminated resin portions when the photosensitive resin is of the positive type, or removing non-illuminated resin portions when the photosensitive resin is of the negative type, etching the silicon oxide layer in the portions removed from the resin, removing all the resin, and etching the silicon substrate, the structured silicon oxide layer acting as the etching mask in order to produce the upper part.

* * * * *